United States Patent [19]

Miles

[11] 4,302,847

[45] Dec. 1, 1981

[54] BODY PROTECTIVE CLOTHING

[76] Inventor: Bertrand H. Miles, 788 Columbus Ave., New York, N.Y. 10025

[21] Appl. No.: 77,518

[22] Filed: Sep. 20, 1979

[51] Int. Cl.[3] ..... A41D 13/00

[52] U.S. Cl. ..... 2/2; 2/94; 2/102; 2/227

[58] Field of Search ..... 2/2, 2.5, 94, 97, 102

[56] References Cited

U.S. PATENT DOCUMENTS

| | | | |
|---|---|---|---|
| 744,477 | 11/1903 | Bush | 2/2 X |
| 2,338,535 | 1/1944 | Pfleumer | 2/2 X |
| 2,368,654 | 2/1945 | Frank | 2/94 |
| 2,621,327 | 12/1952 | Amoroso | 2/2 |
| 2,796,208 | 6/1957 | O'Leary et al. | 2/2 X |
| 3,116,489 | 1/1964 | Weiss | 2/2 X |
| 3,500,422 | 3/1970 | Castellani | 2/2.5 X |
| 3,909,847 | 10/1975 | Holt et al. | 2/2 |
| 3,921,222 | 11/1975 | Hollman | 2/2 |
| 4,151,613 | 5/1979 | Rhee | 2/2 |

FOREIGN PATENT DOCUMENTS

| | | | |
|---|---|---|---|
| 63435 | 2/1914 | Austria | 2/2 |
| 586547 | 4/1977 | Switzerland | 2/2 |

*Primary Examiner*—H. Hampton Hunter

*Attorney, Agent, or Firm*—Blum, Kaplan, Friedman, Silberman & Beran

[57] ABSTRACT

Body protective clothing to be worn over or in place of outer garments for protection while actively participating in various sports is provided. A zippered vest-type garment including a resilient foam insert strategically located along the lower portion of the torso includes adjustable front closure straps for maintaining the position of the foam about the lower back and hip bones. A harness-type construction having crossed-adjustable shoulder straps and a closure belt portion also provides impact protection about the lower back and hip bones of the wearer. Stretch-type pants are provided with pockets in the regions of the hip and lower back for receiving foam pads when desired.

12 Claims, 9 Drawing Figures

BODY PROTECTIVE CLOTHING

BACKGROUND OF THE INVENTION

This invention relates generally to body protective clothing, and in particular to body protective clothing including strategically located foam pads for protecting the lower back and hip regions of a wearer. As more and more people undertake active participation in sports, such as skiing, roller skating, ice skating, skate boarding and the like, the susceptibility to injury of the lower torso and back due to impact increases. While professional athletes have long been provided with a sophisticated assortment of armor and various pads, such as shoulder pads, knee pads and the like, the recreactional participant has not had suitable body protective clothing which is acceptable from an aesthetic standpoint, yet provides realistic impact protection.

Accordingly, it would be desirable to provide body protective clothing which could be worn in place or in addition to outer garments while a person participates actively in a sport wherein the torso may be subjected to impact.

SUMMARY OF THE INVENTION

Generally speaking, in accordance with the invention, body protective clothing which may be worn in place of or in addition to outer sports garments is provided. The body protective clothing in accordance with one embodiment of the invention is a zippered vest-type garment including a foam insert disposed about the lower portion of the vest. The vest is formed from at least two layers of a wind-proof nylon type material for providing improved wind resistance when the vest is worn during such winter sports as skiing or ice skating. Two adjustable crotch straps are anchored at the lower rear portion of the vest and pass through a wearer's crotch to brackets at the forward hip regions for maintaining the vest and foam insert in its desired position.

In a second embodiment of the invention a harness-type construction is provided which includes an elongated foam insert in a nylon-type case for encircling the lower back region and the hip region. A closure belt for securing the pad about the torso is anchored to one end of the nylon case and selectively secured to the other end. The shoulder straps of the harness are adjustable so that the protective harness may be worn by different size users. In a further embodiment of the invention stretch pants, such as stretch ski pants are formed with three strategically located impact pockets for receiving a foam insert. A pocket is provided at each side seam region for hip regions and a back pocket is provided for protecting the lower back region.

Accordingly, it is an object of the invention to provide improved body protective clothing.

Another object of the invention is to provide improved body protection clothing which is adjustable and can be utilized by different size users.

A further object of the invention is to provide improved body protective clothing which provides additional weather protection.

Still another object of the invention is to provide improved body protective clothing having improved means for maintaining the proper position on a wearer.

Still a further object of the invention is to provide improved body protective clothing which is light weight and suitable for warm weather sports.

Another object of the invention is to provide improved body protective clothing wherein the clothing may be used with the protective means removed.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
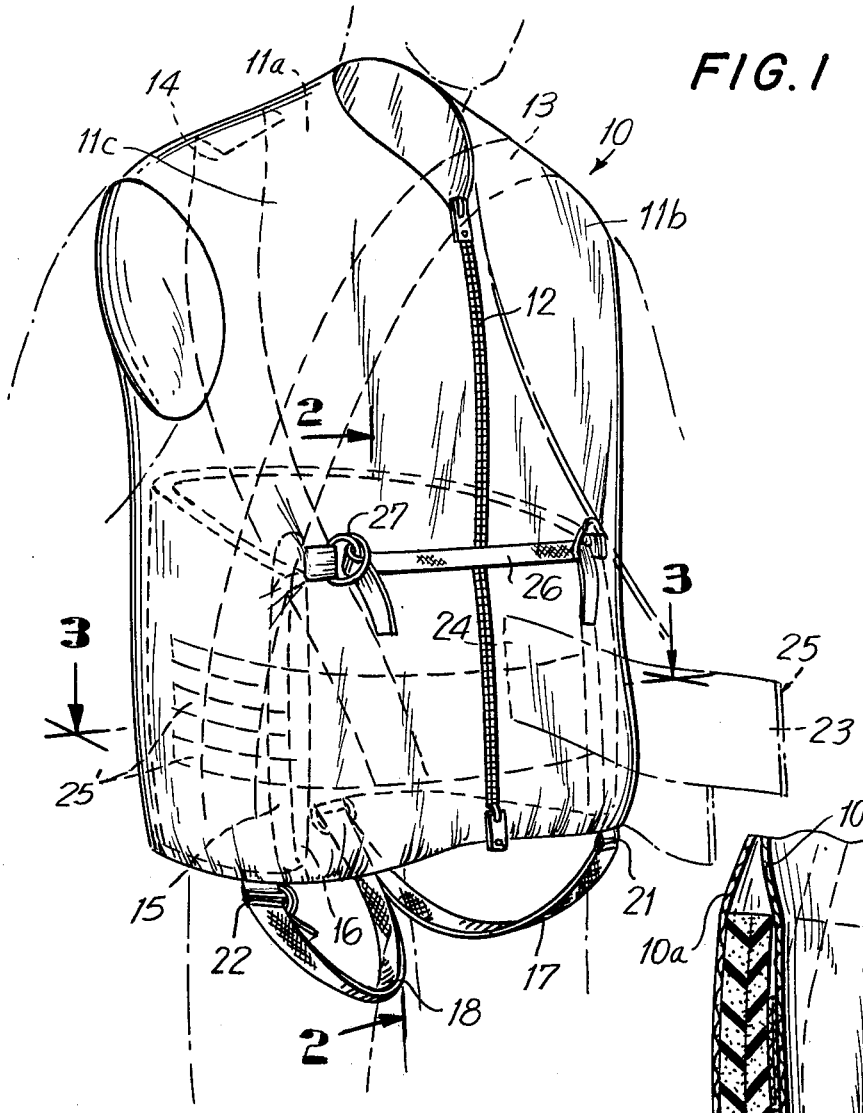
FIG. 1 is a perspective view illustrating the vest-type protective body clothing constructed and arranged in accordance with the first embodiment of the invention.

Referring now to FIG. 1, a perspective view of a vest-type body protective clothing constructed and arranged in accordance with the invention is illustrated generally as 10. Vest 10 is formed with a back region **11*a* and a left-front region 11*b* and a right-front region 11*c* joined to back region 11*a*. Left front region 11*b* and right front region 11*c* are joined by a two-way zipper 12 extending from the upper region to the lower region of the front of vest 10. Back region 11*a* of vest 10 includes a pair of crossed reinforcing straps 13 and 14 running from the lower back region of back region 11*a* to the middle of the upper region about the shoulders for providing increased strength to vest 10**.

Figure 2:
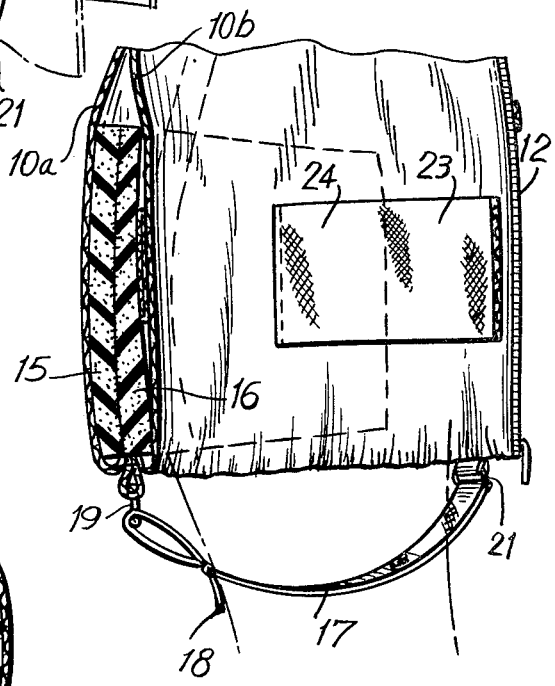
FIG. 2 is a sectional view taken along line 2—2 of FIG. 1.
Figure 3:
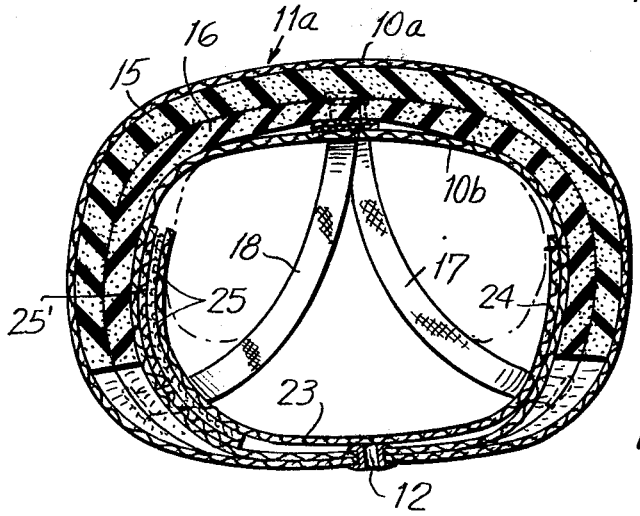
FIG. 3 is a sectional view taken along line 3—3 of FIG. 1.

The material for vest 10 is a nylon-type material which is wind-proof and includes an outer vest panel **10*a* and an inner vest panel 10*b*. The desired impact protection is provided by two layers of impact absorbing resilient foam inserts 15 and 16 which are cut from a foam rubber sheet, such as a neoprene or urethane-type foam. Foam inserts 15 and 16 are positioned along the lower portion of vest 11 between outer vest panel 10*a* and inner vest panel 10*b* as shown in the sectional view in FIGS. 2 and 3. Vest 10 is held in position when worn by a left crotch strap 17 and a right crotch strap 18 which are anchored at the middle of back region 11*a* of vest 10 by metal ring 19 and at the front of vest 10 just forward of the hip bone by a left buckle 21 and a right ring buckle 22**.

Vest 10 is held securely about the lower torso region of a wearer by an inner closure belt 23 anchored on the inside of left-front region 11*b* at 24 and formed with Velcro type material 25 on the outer surface of inner belt 23 for meeting with cooperating Velcro patch 25' formed on the inner surface of right-front region 11*c*. After inner belt 23 is securely closed, zipper 12 is closed to shield inner belt 23 from opening and complete the additional weather protection provided by the panels 11*a* and 11*b* of vest 10. In addition, an outer closure strap 26 is provided along the upper region of foam pads 15 and 16 anchored at the left-front panel 11*b* and closed by a closure ring buckle 27 mounted on the outer surface mounted right-front region 11*c*.

After securing inner strap 24 and zipper 12, outer strap 26 is tightened and crotch straps 17 and 18 are adjusted for securingly positioning body protective vest 10 on a wearer. This secure position provides the desired impact protection along the lower back and hip region of a wearer and provides additional wind-proofing protection in view of outer panel 10*a* and inner panel 10*b* of nylon material. It should be noted that both crotch straps 17 and 18 are adjustable by pulling strap 18 at buckle 22 thereby permitting vest 10 to be worn by different size users.

Figure 4:
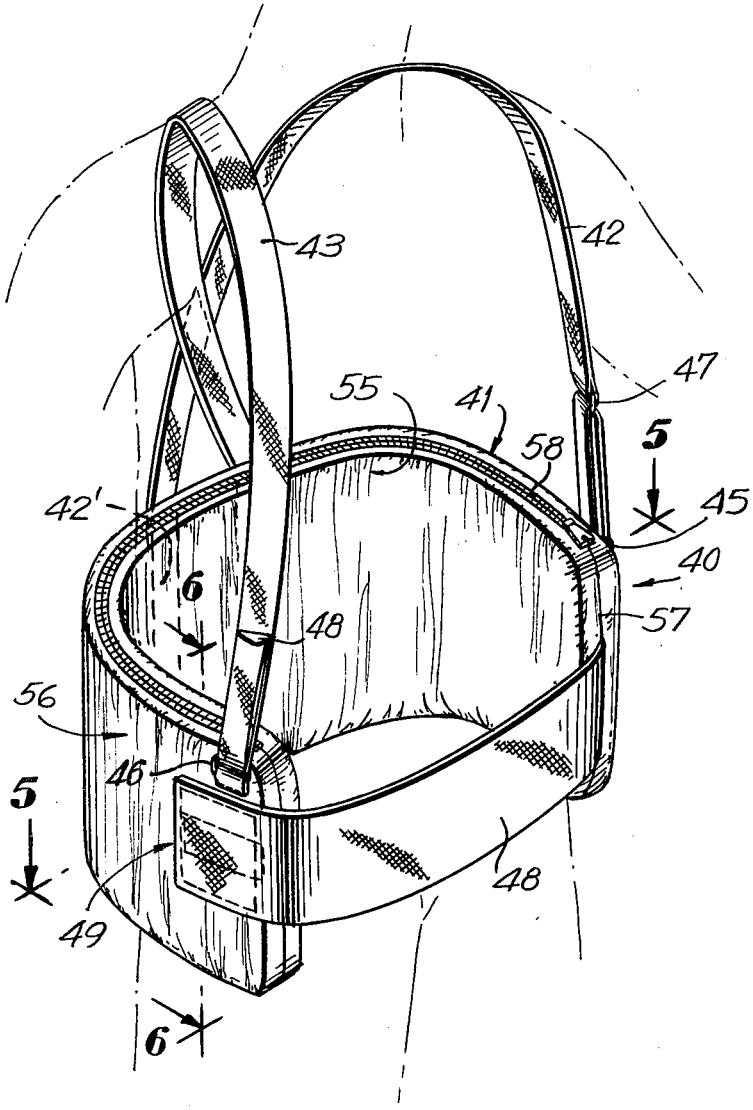
FIG. 4 is a perspective view of harness-type body protective clothing constructed and arranged in accordance with the second embodiment of the invention.

Referring now to FIG. 4, a harness-type body protective clothing constructed and arranged in accordance with the second embodiment of the invention is shown generally at 40. Harness 40 includes a foam protective pad region shown generally as 41 for covering the lower back and hip regions of a wearer. Harness 40 includes a pair of adjustable shoulder straps 42 and 43 which intersect along the back of a wearer and are secured to each other at an intersection 44. Straps 42 and 43 are anchored along the central area of the back of pad region 41 42' and 43', respectively, and are secured at the front of pad 41 on the left side by a ring 45 and on the right side by a ring 46. Straps 42 and 43 are adjustable by moving a pair of adjusting clips 47 and 48 in the same manner as one adjusts a pair of suspenders.

Figure 6:
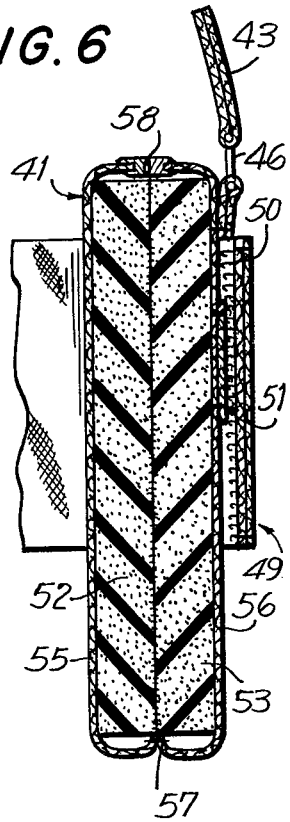
FIG. 6 is a sectional view taken along line 6—6 of FIG. 4.
Figure 5:
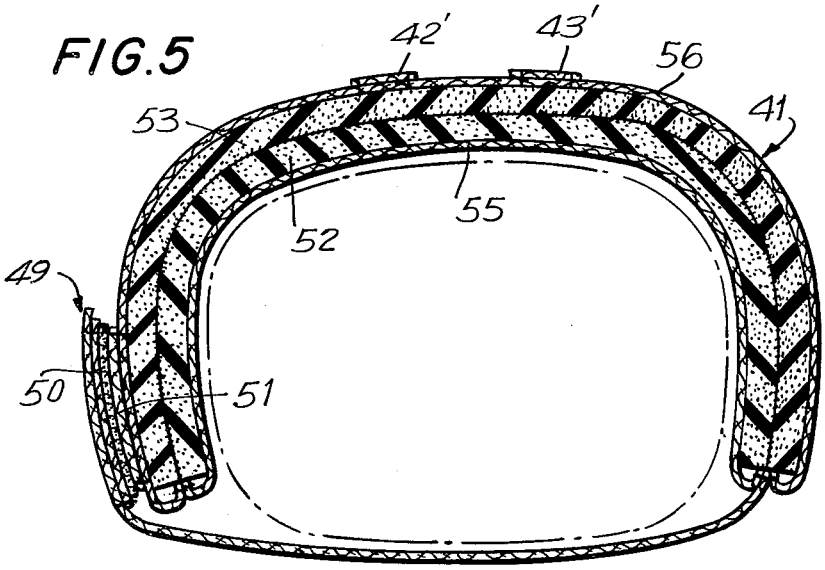
FIG. 5 is a sectional view taken along line 5—5 of FIG. 4.

As shown more clearly in the sectional views in FIGS. 5 and 6, foam pad region 41 includes an inner layer 52 and an outer layer 53 of a flexible form material, such as a synthetic rubber or urethane foam. The pad of foam layers 52 and 53 is disposed in an envelope of rugged rip-stop nylon material formed from an inner face 55 and an outer face 56 joined at a seam 57 thereby permitting removal of pads 52 and 53 which facilitates washing or repairing of the nylon portions of harness 40.

Harness 40 includes an adjustable front closure belt 48 anchored on the left side at seam 57 and is placed across the front of the wearer to the right side of pad region 41 and is secured to the outer surface of outer face 56 by a Velcro closure shown generally as 49. A first region of Velcro material 50 is provided on the interior surface of belt 48 and a cooperating second region of Velcro material 51 provided on the outer surface of outer face 56 for cooperating therewith.

Harness 40 as illustrated in FIGS. 4–6 is shaped to cover the lower back region of the wearer and extend about to the front of the wearer just in front of the region about the hips. In this manner harness 40 provides protection to the lower regions of the torso most likely to be impacted during active participation in such sports as roller skating. It is particularly suitable for warm weather sports as the harness is light-weight and does not cover more than the regions to be protected.

Figure 7:
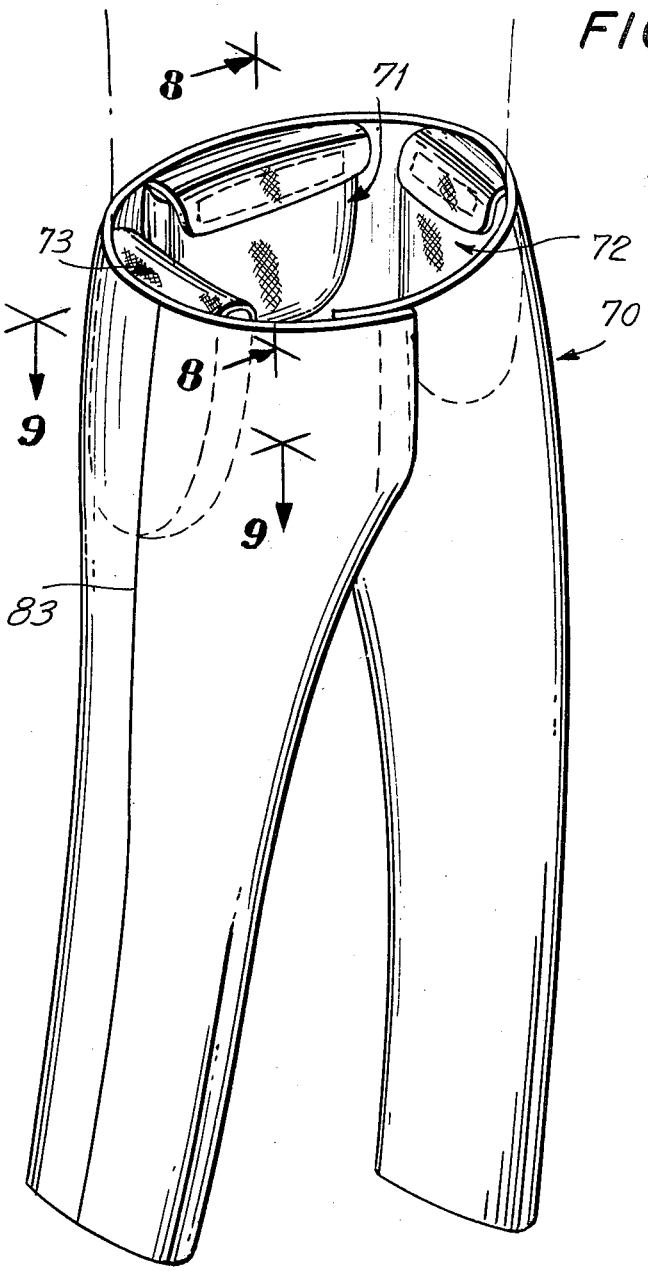
FIG. 7 is a perspective view of body protective clothing constructed and arranged in accordance with the third embodiment of the invention.

Referring now to FIG. 7, a pair of stretch-type ski pants constructed and arranged in accordance with a third embodiment of the invention is illustrated generally at 70. Pants 70 are made from stretch wool and or synthetic materials conventionally used for ski pants. In accordance with the invention, pants 70 includes a back pocket 71 and a left hip pocket 72 and a right hip pocket 73 anchored to the inner surface of pants 70.

Figure 8:
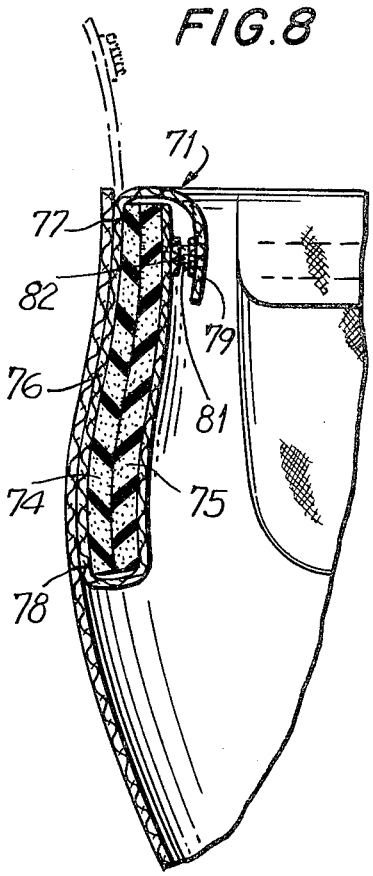
FIG. 8 is a sectional view of the body protective clothing illustrated in FIG. 7 taken along line 8—8.
Figure 9:
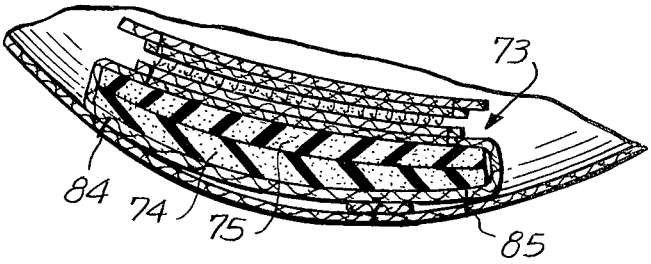
FIG. 9 is a sectional view of the body protective clothing as illustrated in FIG. 7, taken along line 9—9.

The pockets are formed for receipt of a foam insert formed from an outer foam layer 74 and an inner foam layer 75 as shown in the sectional views in FIGS. 8 and 9. Rear pocket 71 is formed with a width between about 8 and 10 inches and a depth of between 6 to 10 inches for providing protection in the lower back region. Similarly, hip pocket 72 and 73 are made about 6 to 8 inches in width and a depth of from about 8 to 12 inches for providing sufficient protection to the hip region of a wearer.

Referring specifically to FIG. 8, rear pocket 71 shown formed from a fold of material 76 anchored by stitching or the like at 77 and 78 and includes a flap 79 having a Velcro closure region 81 on the interior surface of flap 79 for meeting with a Velcro region 82 formed on the outer surface of the front of pocket 71. As shown in the sectional view in FIG. 9, hip pockets 72 and 73 are formed in a similar manner, hip pocket 72 anchored to the hip region of pants 70 on both sides of right leg side seam 83 at anchor stitch runs 84 and 85. Left hip 73 and right hip pocket 72 are similarly constructed as described with respect to rear pocket 51 for allowing removal of the foam inserts. Additionally, foam inserts of varying rigidity and thicknesses may be used.

By constructing pants 70 in this manner, the wearer is free to remove foam inserts from the pocket when not actively participating in the sport or when protection is no longer desired. In this manner, additional outer protective clothing is not necessary and the body protective aspects of pants 70 may be provided when and if desired. Additionally, the weather protection and close fit provided by conventional stretch ski pants is maintained in the body protective clothing constructed and arranged in accordance with the invention.

Accordingly, by providing a body protective vest in accordance with the invention, a wearer is provided with securely placed impact protection and additional weather protection provided by vest material. Alternatively, should this additional weight or weather protection not be desired, the harness type construction provides suitable protection about the lower torso region. In addition, impact protection may be provided in accordance with the third embodiment of the invention wherein hip and rear pockets are provided on stretch ski clothing for receiving foam inserts in strategic locations.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A protective garment for protecting the lower back and hip regions of a user from injuries due to impact while participating in active sports and not interfering with such participation, comprising:

a garment shell formed from a rugged-flexible cloth material having an inner panel shaped to cover at least the lower back and hip regions of the user and a cooperating outer panel joined to said inner panel for forming a substantially elongated pocket therebetween extending across the torso of the user;

a flexible-impact resistant foam insert shaped to fit into said pocket inserted into said pocket;

shoulder means for supporting said garment with the flexible foam inserts surrounding the lower back and hip regions by hanging from the shoulders of the user;

adjustable closure means across the front of the user for adjustably closing and securing said flexible foam insert in said pocket about the lower back and hip region of the user and adjustable crotch straps means adjustably anchored across the lower portion of the garment for fixing the position of the garment vertically on the user.

2. The protective garment of claim 1, wherein said shoulder means includes a vest of said cloth material extending from said garment shell over the back and front regions of the user.

3. The protective garment of claim 2 including a zipper extending substantially vertically in the front of said garment shell.

4. The protective garment of claim 3, wherein said closure means includes a belt joined to the inner garment panel in the region of one of the hips and extends across the front of the user and means for selectively securing said belt to the inner panel in the region of the other hip.

5. The protective garment of claim 4, wherein said means for securing the belt is a Velcro closure.

6. The protective garment of claim 5 wherein said closure means further includes an adjustable pull strap anchored at one side of the region of the vest and adjustably tightenable at the other front side of the vest for further securing the garment about the user.

7. The protective garment of claim 2 including a pair of cross reinforcing straps each running from one shoulder region to an opposed lower back region of the vest.

8. The protective garment of claims 1 or 7 wherein said cloth material is a rip-stop nylon.

9. The protective garment of claim 1 wherein said garment shell is substantially elongated in shape for covering the lower back and hip regions and includes a strap extending from one of the shorter dimensions of the shell and is selectively securable to the opposed shorter dimension of the shell.

10. The protective garment of claim 9 further including a Velcro closure for selectively closing the belt.

11. The protective garment of claim 9 wherein said shoulder means are adjustable shoulder straps anchored at the back region of the garment shell and opposed forward regions of the garment shell.

12. The protective garment of claim 11 wherein said garment shell includes a zipper across the upper region between said inner and outer panel for permitting selective removal of the foam inserts.

* * * * *